US007896319B2

(12) United States Patent
Fujii et al.

(10) Patent No.: US 7,896,319 B2
(45) Date of Patent: Mar. 1, 2011

(54) SAUNA APPARATUS

(75) Inventors: Satoshi Fujii, Aichi (JP); Yoshio Ikari, Aichi (JP)

(73) Assignee: Panasonic Corporation, Osaka (JP)

( * ) Notice: Subject to any disclaimer, the term of this patent is extended or adjusted under 35 U.S.C. 154(b) by 1063 days.

(21) Appl. No.: 11/617,229

(22) Filed: Dec. 28, 2006

(65) Prior Publication Data

US 2008/0157410 A1 Jul. 3, 2008

(51) Int. Cl.
*B01F 3/04* (2006.01)

(52) U.S. Cl. ..... 261/28; 261/78.2; 261/89; 4/524

(58) Field of Classification Search ..... 261/28, 261/53, 78.2, 89, 90, 142; 4/524
See application file for complete search history.

(56) References Cited

U.S. PATENT DOCUMENTS 287,898 A * 11/1883 Bancroft ..... 261/71
4,833,739 A 5/1989 Sakakibara et al.
6,497,717 B1 * 12/2002 Daffer et al. ..... 607/83

FOREIGN PATENT DOCUMENTS

| | | | |
|---|---|---|---|
| JP | 63-238864 | A | 4/1988 |
| JP | 04-054964 | | 2/1992 |
| JP | 04-251132 | A | 9/1992 |
| JP | 11-022907 | A | 1/1999 |
| JP | 11-304203 | | 11/1999 |
| JP | 2002-336327 | | 11/2002 |
| JP | 2002-336327 | A | 11/2002 |
| JP | 2006-25967 | A | 2/2006 |

OTHER PUBLICATIONS

China Office Action for Application No. 2006/10128575.7 (with English language translation), Oct. 23, 2009.

* cited by examiner

*Primary Examiner*—Scott Bushey
(74) *Attorney, Agent, or Firm*—RatnerPrestia

(57) ABSTRACT

A sauna apparatus includes a heating section for heating air to generate heated air, a heated-air-blowing section for sending the heated air, a humidifying section for humidifying air to generate humidified air, a humidified-air-blowing section for sending the humidified air, a merging chamber for mixing the sent heated air and the sent humidified air to generate heated and humidified air, and an outlet for blowing the heated and humidified air generated. This sauna apparatus provides air having uniform temperature distribution and uniform humidity distribution, and allows temperature and humidity to be controlled easily.

4 Claims, 5 Drawing Sheets

SAUNA APPARATUS

FIELD OF THE INVENTION

The present invention relates to a sauna apparatus which allows a room, such as a bathroom, to function as a sauna space with a high temperature and a high humidity.

BACKGROUND OF THE INVENTION

FIG. 6 is a sectional view of mist apparatus 103 disclosed in Japanese Patent Laid-Open Publication No. 2002-336327. Mist apparatus 103 is a conventional sauna apparatus which is mounted onto a ceiling of a bathroom and cause the bathroom to function as a sauna room. Circulation fan 101 and movable louver 102 are provided in case 103A. Case 103A is covered with grill board 104. Circulation air path 107 is provided in case 103A. Air in the bathroom is sucked through circulation air path 107 via inlet 105, and is blown out from outlet 106. Circulation fan 101 causes the air to pass in circulation air path 107. Heat exchanger 108 heats the air passing through circulation air path 107. Movable louver 102 changes a blowing direction in which the air is blown out from outlet 106. Ventilation fan 110 sucks the air in the bathroom and exhausts the sucked air outside via exhaust duct 109. Mist spouting section 111 spouts mist in the bathroom from a side of inlet 105.

Mist apparatus 103 blows only heated air from outlet 106, and spouts the mist from mist spouting section 111 separately. Thus, the heated air and the mist are not mixed each other, hence preventing the air from having temperature and humidity uniformly distributed. Further, the mist is spouted separately from the heated air in the bathroom, hence preventing a user from reading books in the bathroom, and causing waterdrops to adhere to his/her glasses. Furthermore, whole temperature and humidity in the bathroom can not be controlled easily.

SUMMARY OF THE INVENTION

A sauna apparatus includes a heating section for heating air to generate heated air, a heated-air-blowing section for sending the heated air, a humidifying section for humidifying air to generate humidified air, a humidified-air-blowing section for sending the humidified air, a merging chamber for mixing the sent heated air and the sent humidified air to generate heated and humidified air, and an outlet for blowing the heated and humidified air generated.

This sauna apparatus provides air having uniform temperature distribution and uniform humidity distribution, and allows temperature and humidity to be controlled easily.

DETAIL DESCRIPTION OF THE PREFERRED EMBODIMENT

Figure 1:
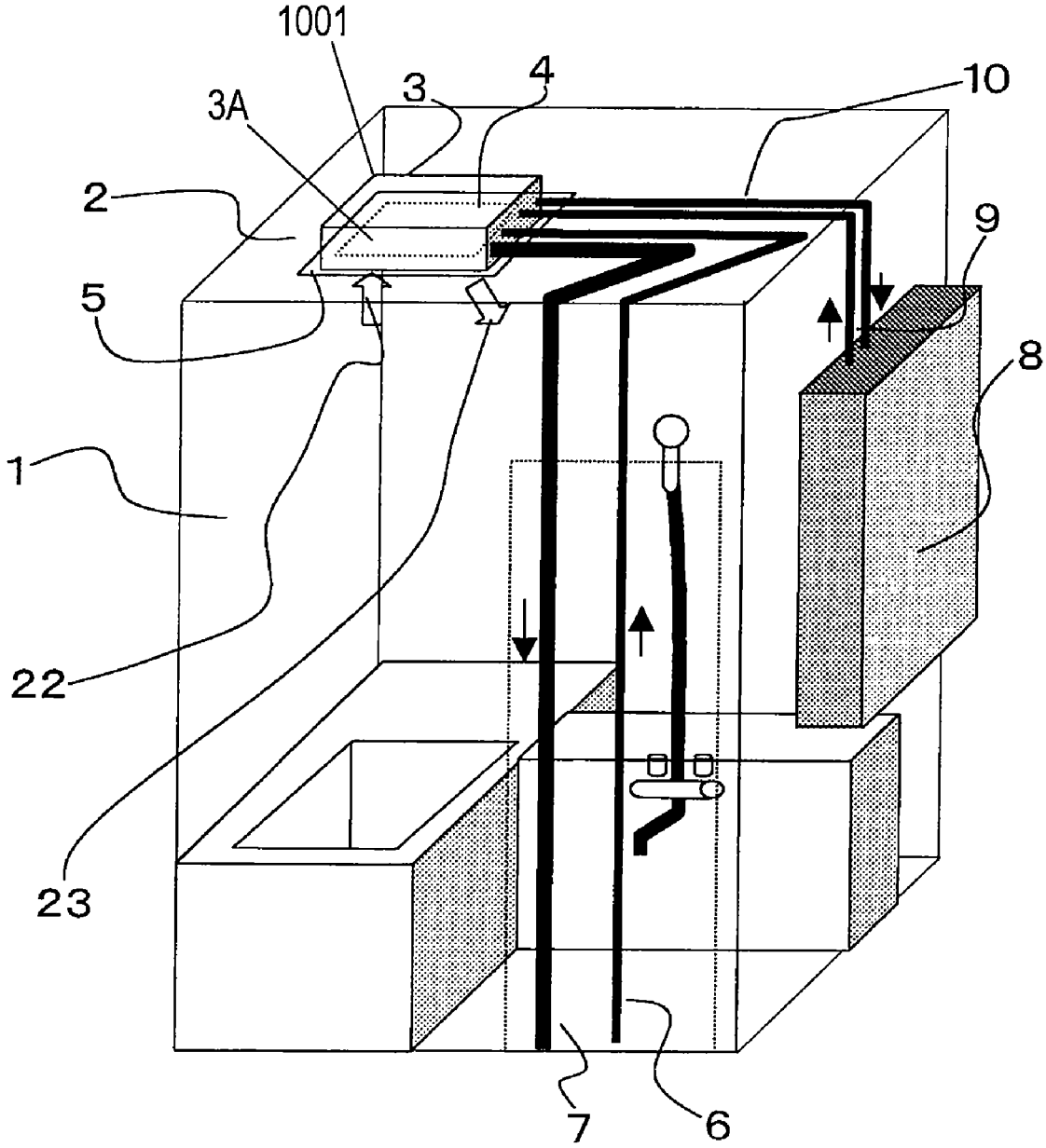
FIG. 1 is a perspective view of a room having a sauna apparatus mounted thereto in accordance with an exemplary embodiment of the present invention.

FIG. 1 is a perspective view of room 1 having sauna apparatus 1001 mounted thereto in accordance with an exemplary embodiment of the present invention is placed. Sauna apparatus 1001 includes case 3 having lower surface 3A having opening 4 formed therein. Case 3 of sauna apparatus 1001 is provided in space 2 of the back of the ceiling at room 1. Opening 4 formed in lower surface 3A of case 3 communicates with room 1 via ceiling-opening 5. Case 3 is coupled with feed pipe 6 and drain pipe 7. Feed pipe 6 supplies cold or hot water into case 3. Drain pipe 7 drains water from case 3. Water heater 8, a heat source, heats water to generates hot water, and is coupled with outward pipe 9 and return pipe 10 which provide a circuit to circulate the hot water therein. In the case that room 1 and the inside of case 3 are heated, hot water is supplied from water heater 8 to case 3 via outward pipe 9, then, is heat-exchanged with the inside of case 3, and then, returns to water heater 8 via return pipe 10. Tap water is sent into case 3 via feed pipe 6. A part of the sent water is used for humidifying room 1 or the inside of case 3, and the rest of the sent water is drained via drain pipe 7.

In the case that room 1 or the inside of case 3 is heated and humidified, hot water is supplied from water heater 8 to case 3 via outward pipe 9, and tap water is sent into case 3 via feed pipe 6. The hot water is heat-exchanged with the inside of case 3, and then returns to water heater 8 via return pipe 10. Apart of the tap water supplied from feed pipe 6 is used for humidifying, and the rest of the supplied water, which is not used for the humidifying, is drained from drain pipe 7.

Figure 2:
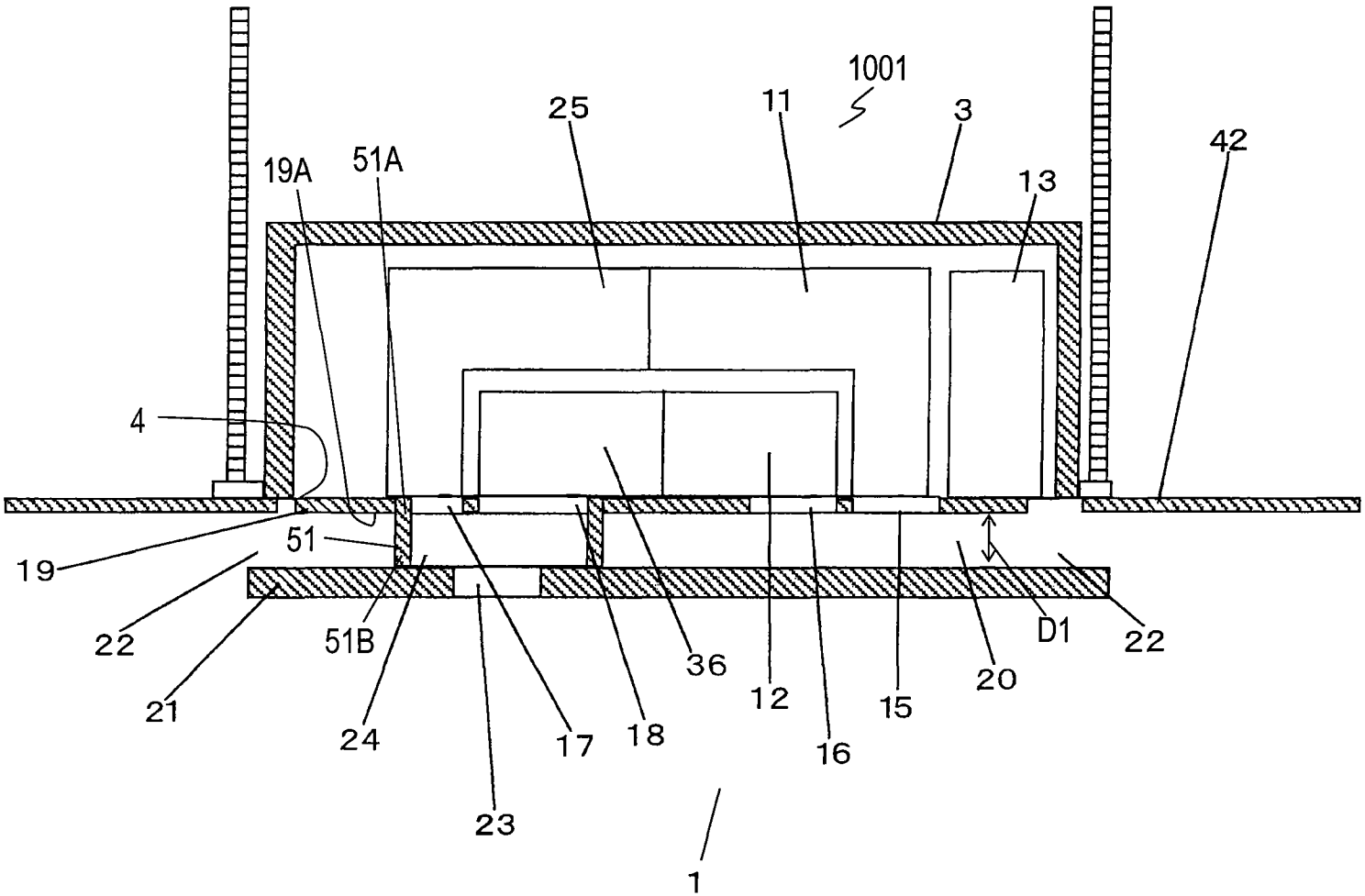
FIG. 2 is a schematic sectional view of the sauna apparatus in accordance with the embodiment.
Figure 3:
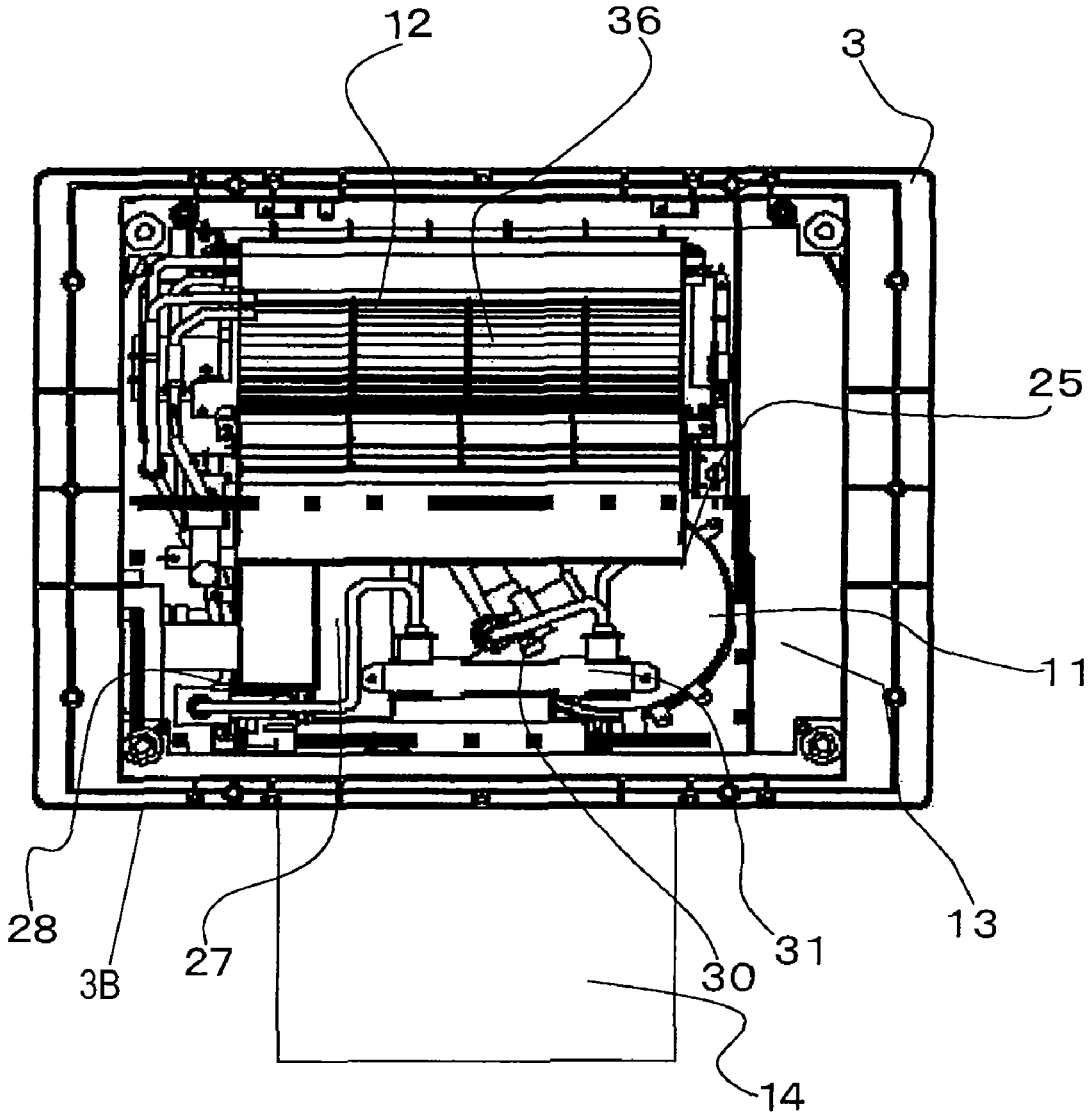
FIG. 3 is a bottom view of the sauna apparatus in accordance with the embodiment.

FIGS. 2 and 3 are a schematic sectional view and a bottom view of sauna apparatus 1001, respectively. Case 3 has a box shape having lower surface 3A having opening 4 formed therein. Case 3 accommodates therein humidifying section 11, heating section 12, and controller 13. Ventilating section 14 communicates with the inside of the case at side surface 3B of case 3. Controller 13 is electrically coupled with humidifying section 11, heating section 12, and ventilating section 14. Inner panel 19 is provided at opening 4 of lower surface 3A. Outer panel 21 is located away from inner panel 19 by predetermined distance D1. Inlet 15 for humidifying, inlet 16 for heating, outlet 17 for humidifying, and outlet 18 for heating are formed in inner panel 19. Outer panel 21 covers inlet 15 for humidifying and inlet 16 for heating of inner panel 19 while being distanced from the inlets by a predetermined distance D1, thereby providing sucked-air flow path 20 and inlet 22. Sucked-air path 20 communicates with inlet 15 for humidifying and inlet 16 for heating. Sucked-air flow path 20 opens at inlet 22. Upper end 51A of cylinder 51 is fixed to lower surface 19A of inner panel 19 so as to surround outlet 17 for humidifying and outlet 18 for heating. Lower end 51B of cylinder 51 is fixed to outer panel 21. Outlet 23 for blowing heated and humidified air to room 1 is provided in outer panel 21. Lower end 51B of cylinder 51 opens via outlet 23 of outer panel 21. Cylinder 51 placed before outlet 23 provides merging chamber 24 in which the humidified air blown from outlet 17 for humidifying and the heated air blown from outlet 18 for heating are merged to be mixed.

Figure 4:
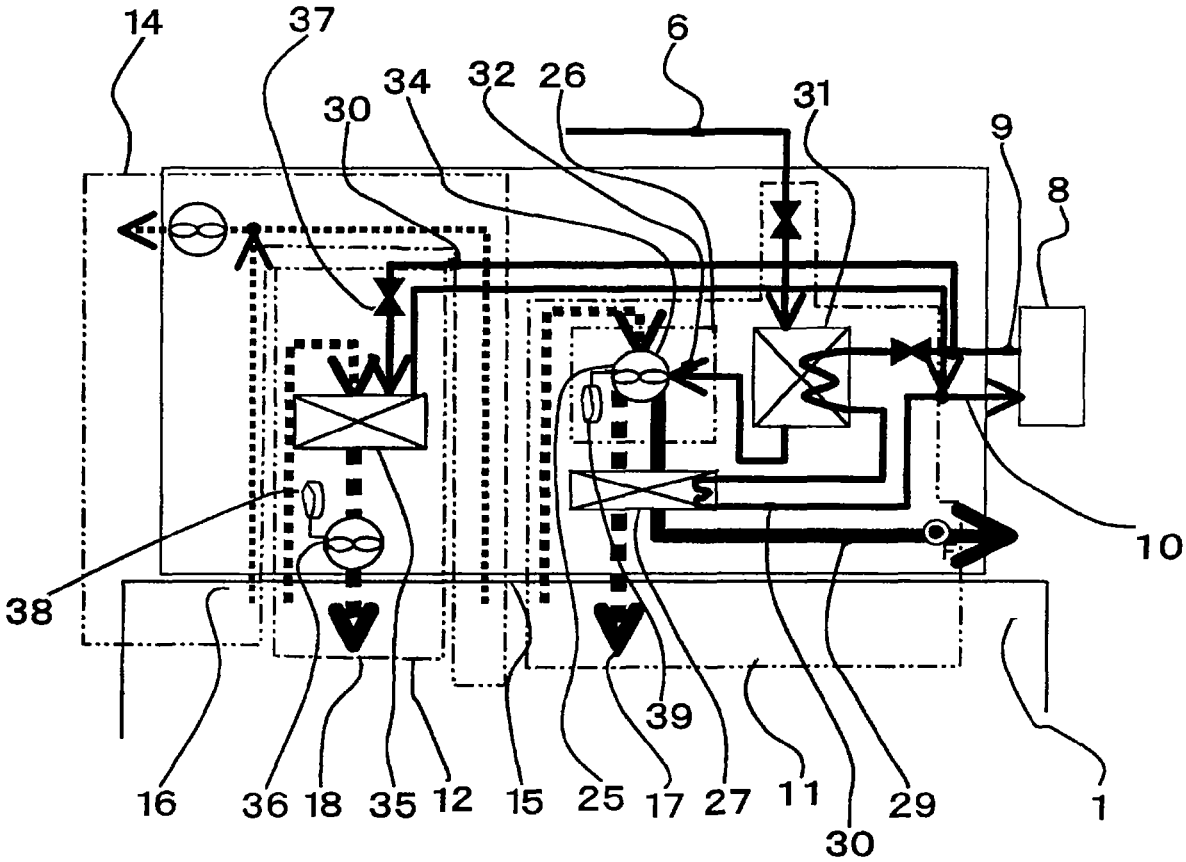
FIG. 4 is a schematic diagram of the sauna apparatus in accordance with the embodiment.

FIG. 4 is a schematic diagram of sauna apparatus 1001. Humidifying section 11 includes humidified-air-blowing section 25, water-shattering section 26, vapor-liquid separating section 27, water-feeding section 28, water-drain section 29, and hot-water circuit 30. Humidified-air-blowing section 25 causes air to be sucked from room 1 to inlet 15 for humidifying. The sucked air passes through water-shattering section 26 and vapor-liquid separating section 27, and is blown to merging chamber 24 through outlet 17 for humidifying. Hot water is sent from water heater 8, a heat source of water-shattering section 26, passes through an inlet-connecting section for the hot-water circuit via outward pipe 9 for the hot-water circuit, and sent to heat exchanger 31. Heat exchanger 31 changes the tap water sent from water-feeding section 28 into hot water by heat-exchanging the hot water to the tap water. The hot water is injected from injecting section 32 of water-shattering section 26 communicating with water-feeding section 28.

Figure 5:
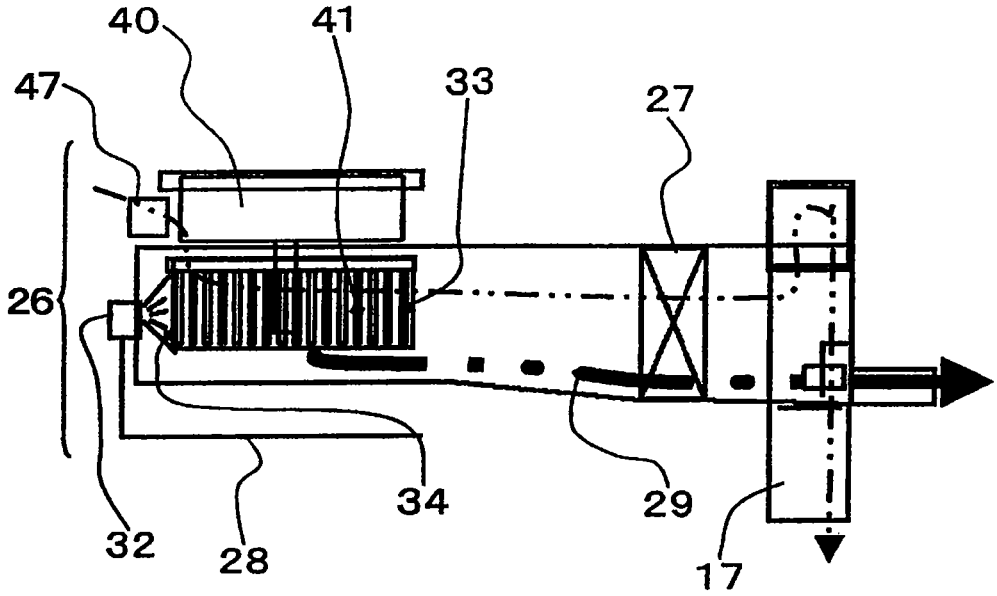
FIG. 5 is a sectional view of a humidifying section of the sauna apparatus in accordance with the embodiment.
Figure 6:
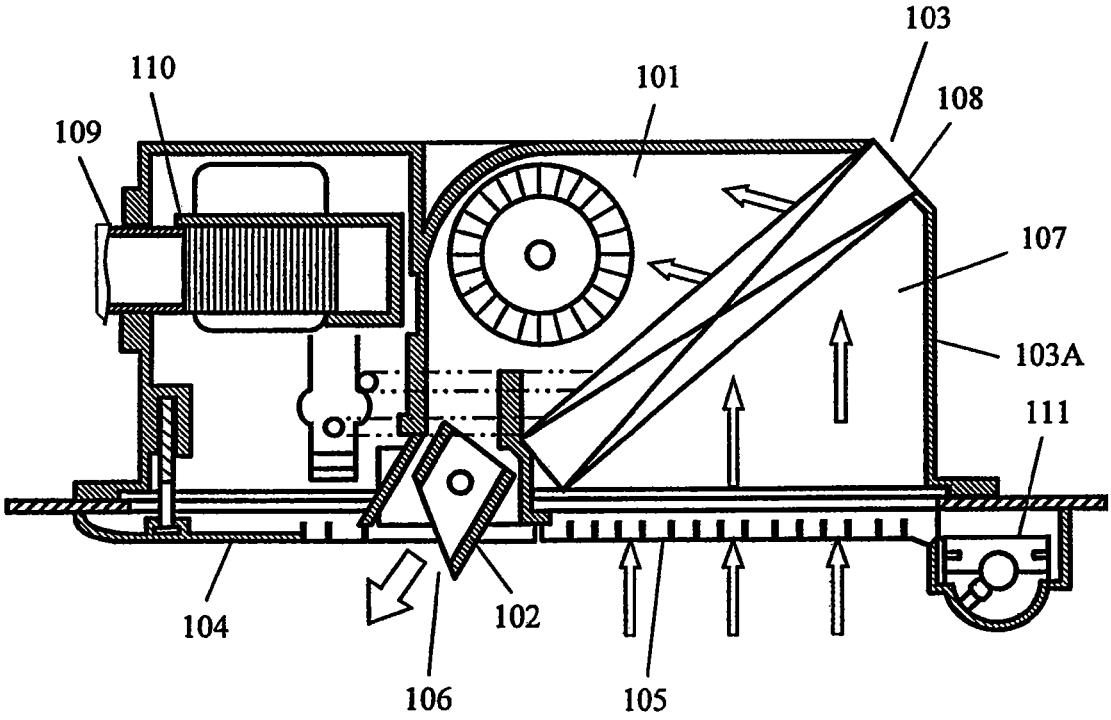
FIG. 6 PRIOR ART
FIG. 6 is a sectional view of a conventional mist apparatus.

FIG. 5 is a sectional view of humidifying section 11 of sauna apparatus 1001. The hot water injected from injecting section 32 collides with collision section 34 including collision fan 33 provided in water-shattering section 26, and is shattered into waterdrops. The waterdrops flows on airflow generated by humidified-air-blowing section 25, and pass through vapor-liquid separating section 27. When the waterdrops with the air pass through vapor-liquid separating section 27 with air, the waterdrops are separated into large waterdrops and fine waterdrops smaller than the large waterdrops. Then, humidified air 81 including only fine waterdrops is sent from outlet 17 for humidifying to merging chamber 24. The separated large waterdrops are drained from humidifying section 11 as water 82.

Heating section 12 includes hot-water coil 35 for heating and heated-air-blowing section 36. Heated-air-blowing section 36 sent the air from room 1 into heating section 12 via inlet 16 for heating. Hot water is supplied from water heater 8 to hot-water coil 35 for heating through the inlet-connecting section for the hot-water circuit via outward pipe 9 of the hot-water circuit and open/close section 37 for heating. Open/close section 37 opens and closes a flow of water. Heated air is generated by heat-exchanging air and hot water in hot-water coil 35. The heated air passes through heated-air-blowing section 36, and is sent from outlet 18 for heating to merging chamber 24. Humidified air is blown into merging chamber 24 from outlet 17 for humidifying. The heated air is merged into the humidified air, and heated and humidified air is blown into room 1 from outlet 23.

Heated-blow adjusting section 38 for changing the amount of the heated air is provided at heated-air-blowing section 36. Humidified-blow adjusting section 39 for changing the amount of humidified air is provided at humidified-air-blowing section 25.

Water-shattering section 26 includes injecting section 32 and collision section 34. Water-feeding section 28 for applying a pressure to water or hot water is linked with a nozzle of injecting section 32. The water or hot water having the pressure is injected from the nozzle toward collision fan 33 of collision section 34. Humidified-air-blowing section 25 includes motor 40 for blowing humidified-air, and collision fan 33 linked with a shaft of motor 40 for blowing humidified-air. Collision fan 33 may be a centrifugal fan, such as a scirocco fan.

Collision section 34 includes collision fan 33 having a function of making waterdrops by colliding water or hot water and a function of blowing. The water or hot water injected from the nozzle of injecting section 32 collides with vanes (e.g., plural collision boards 41) of collision fan 33 rotated by motor 40 for blowing humidified air, thereby becoming waterdrops.

An operation of sauna apparatus 1001 will be described below. When sauna apparatus 1001 provided at ceiling surface 42 of room 1 operates, air in room 1 is sucked from inlet 22 communicating with sucked-air flow path 20 provided between inner panel 19 and outer panel 21. The air is sucked into case 3 from inlet 15 for humidifying and inlet 16 for heating both of which are provided in inner panel 19. The air sucked into case 3 is humidified by humidifying section 11 and passes through humidified-air-blowing section 25, and is sent from outlet 17 for humidifying provided in inner panel 19 to merging chamber 24 provided before outlet 23.

The air sucked into case 3 from inlet 16 for heating provided in inner panel 19 is heated by heating section 12. The heated air passes through heated-air-blowing section 36, and is sent from outlet 18 for heating formed at inner panel 19 to merging chamber 24 provided before outlet 23. The humidified air and the heated air both of which have been sent to merging chamber 24 are merged to be mixed, thus providing heated and humidified air. The heated and humidified air is sent into room 1 from outlet 23 provided in outer panel 21, thereby allowing room 1 to function as a sauna room.

The heated and humidified air blown into room 1 has a uniform temperature and a uniform humidity, accordingly allowing sauna apparatus 1001 to makes the temperature and humidity in room 1 uniform.

In humidifying section 11, vapor-liquid separating section 27 separates fine waterdrops from waterdrops, and collects large waterdrops. Accordingly, the humidified air includes only fine waterdrops, and is merged with the heated air in merging chamber 24, thus providing the heated and humidified air with uniform temperature/humidity distribution. This arrangement provides room 1 where a user does not feel waterdrops. Consequently, the user can read books in room 1, so that room 1 can be used for various purposes. Water-shattering section 26 exhibits Lenard effect for making waterdrops fine due to the collision of water, and sends air including a lot of negative ions to room 1.

Heated-air-blowing section 36 includes heated-blow adjusting section 38 for changing the amount of heated air. Humidified-air-blowing section 25 includes humidified-blow adjusting section 39 for changing the amount of humidified air. The amount of humidification increases substantially in proportion to an airflow within a certain range. Therefore, sauna apparatus 1001 can control the amount of humidification easily, and control the temperature and the humidity easily within a range from low-temperature and low-humidity to high-temperature and high-humidity.

Rotatable collision fan 33 of water-shattering section 26 has a function of humidified-air-blowing section 25 and a function of collision section 34, thus having high cost-performance. Collision fan 23 provides water-shattering section 26 utilizes a space effectively. If the waterdrops are made fine only by the nozzle, the amount of humidification depends on a pressure to the water. However, a force for shattering the water depends on the number of revolutions of collision fan 33, so that sauna apparatus 1001 can supply a constant amount of humidification which does not depend on the pressure to the tap water or the hot water supplied.

Openings other than outlet 23 functions as inlet 22 communicating with the sucked-air flow path, so that all openings other than outlet 23 can be used as inlet 22. This structure reduces resistance during the sucking at inlet 22, accordingly allowing humidified-air-blowing section 25 and heated-air-blowing section 36 to operate efficiently.

In an extreme cold area, heating in winter needs humidifying, so that sauna apparatus 1001 can be applied for an air conditioner including a heating apparatus unitarily having a humidifying apparatus.

What is claimed is:

1. A sauna apparatus comprising:

a heating section for heating air to generate heated air;

a heated-air-blowing section for sending the heated air in a first air flow path;

a heated-blow adjusting section for changing the amount of the sent heated air;

a humidifying section for humidifying air to generate humidified air;

a humidified-air-blowing section for sending the humidified air in a second air flow path separate from the first air flow path;

a humidified-blow adjusting section for changing the amount of the sent humidified air;

a merging chamber for mixing the first air flow path and the second air flow path to generate heated and humidified air; and an outlet for blowing the heated and humidified air generated.

2. The sauna apparatus of claim 1, wherein the humidifying section includes a water-feeding section for supplying water, an injecting section for injecting the supplied water, a water-shattering section for shattering the injected water to generate waterdrops, and a vapor-liquid separating section for separating the waterdrops into first waterdrops and second waterdrops smaller than the first waterdrops, and sending the second waterdrops.

3. The sauna apparatus of claim 2, wherein the water-shattering section includes a rotatable collision fan having a plurality of collision boards to be collided with water.

4. The sauna apparatus of claim 1, further comprising:

a sucked-air flow path for sending the air to the heating section and sending the air to the humidifying section; and an inlet communicating with the sucked-air flow path.

* * * * *